United States Patent [19]

Nagase

[11] 4,065,163

[45] Dec. 27, 1977

[54] STRIKE PLATE FOR HOOK BOLT LOCK SETS

[75] Inventor: Mitsuo Nagase, Kurobe, Japan

[73] Assignee: Yoshida Kogyo K.K., Tokyo, Japan

[21] Appl. No.: 718,821

[22] Filed: Aug. 30, 1976

[30] Foreign Application Priority Data

Sept. 1, 1975 Japan ..... 50-121021[U]

[51] Int. Cl.[2] ..... E05C 5/02

[52] U.S. Cl. ..... 292/341.15; 292/244; 292/254

[58] Field of Search ..... 292/244, DIG. 46, 254, 292/341.18, 341.19, 340

[56] References Cited

U.S. PATENT DOCUMENTS

| | | | |
|---|---|---|---|
| 1,144,537 | 6/1915 | Gabriel | 292/254 X |
| 3,316,003 | 4/1967 | Russell et al. | 292/244 |

*Primary Examiner*—Richard E. Moore

*Attorney, Agent, or Firm*—Hill, Gross, Simpson, Van Santen, Steadman, Chiara & Simpson

[57] ABSTRACT

A hook bolt lock set used on the meeting stiles of a pair of sliding doors has a hook bolt lock mounted in one of the meeting stiles and having a hook bolt capable of projection toward and retraction from the other meeting stile in a direction normal to the planes in which the doors are movable. A strike plate is attached to the other meeting stile and has a central opening and a pair of bolt apertures located one on each side of and symmetrically in position with respect to the central opening, one of the bolt apertures being wider in width than the other. When the doors are fully closed and if the hook bolt fails to be received in a narrower bolt aperture, then the strike plate is turned upside down to let a wider one receive the hook bolt unobstructedly.

3 Claims, 4 Drawing Figures

STRIKE PLATE FOR HOOK BOLT LOCK SETS

BACKGROUND OF THE INVENTION

1. Field of the Invention

The present invention relates to a strike plate for a hook bolt lock set used on the meeting stiles of a pair of sliding closure members, such as doors, relatively movable in parallel spaced planes.

2. Description of the Prior Art

Where hook bolt lock sets are used on the meeting stiles of a pair of sliding doors, it is often necessary that the strike plate be adjusted in position to allow the hook bolt to be received in a bolt aperture in the strike plate without obstruction which would otherwise be met with due to dimensional variations of the doors and a frame in which the doors are movably mounted. One of the presently available adjustable strike plates is shown in FIG. 4 of the accompanying drawings and it has a hook bolt receiving aperture and a pair of horizontal slots through which screws can pass to secure the plate to one of the meeting stiles. The strike plate can be shifted in position via the slots depending upon the degree of dimensional variations of the doors and frame. This type of plate adjustment is disadvantageous in that the strike plate is susceptible to displacement when subjected to forces applied along the slots for a long period of time and, as a result, the screws work loose gradually.

SUMMARY OF THE INVENTION

With the prior art drawbacks in view, it is a principal object of the present invention to provide a hook bolt lock set having a strike plate that can be adjusted for proper engagement with the hook bolt simply by inverting the plate itself.

According to the present invention, a hook bolt lock set for use on a pair of sliding doors having a pair of meeting stiles has a strike plate for being attached to one of the meeting stiles. The strike plate has a central opening and a pair of bolt apertures located one on each side of and symmetrically in position with respect to the central opening. One of the bolt apertures is wider in width than the other. When the doors are fully closed and if the hook bolt fails to be received in a narrower bolt aperture due to misalignment, the strike plate is inversed to let a wider one receive the hook bolt unobstructedly.

Many other advantages and features of the present invention will become manifest to those versed in the art upon making reference to the detailed description and the accompanying sheet of drawings in which a preferred structural embodiment incorporating the principles of the present invention is shown by way of illustrative example.

DESCRIPTION OF THE PREFERRED EMBODIMENT

Figure 1:
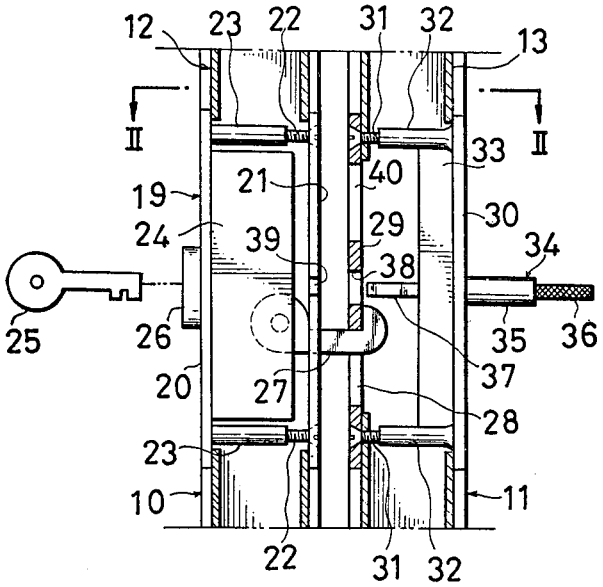
FIG. 1 is a vertical cross-sectional view of a hook bolt lock set with a strike plate according to the present invention, the lock set being used on the meeting stiles of a pair of horizontally sliding doors.
Figure 2:
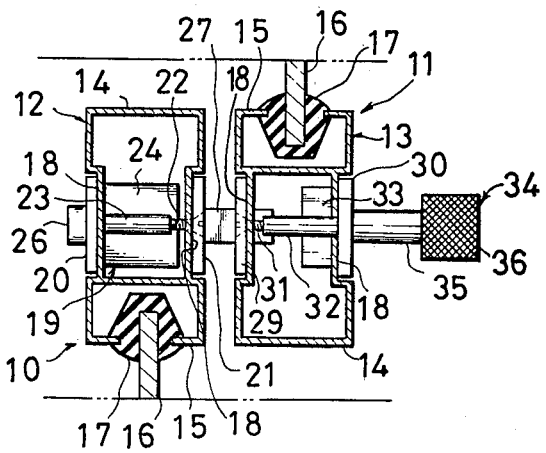
FIG. 2 is a horizontal cross-sectional view taken along line II—II of FIG. 1.
Figure 4:
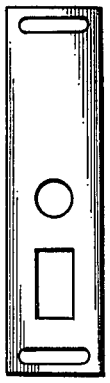
FIG.4 PRIOR ART
FIG. 4 is a front elevational view of a conventional strike plate.

In FIGS. 1 and 2, a pair of horizontally sliding doors 10, 11 have a pair of meeting stiles 12, 13, respectively, the doors 10, 11 being held in closed and locked position. The stiles 12, 13 are made of an aluminum extrusion, each having a hollow section 14 and a channel section 15 supporting a peripheral edge of a panel member 16, such as a pane of glass, with a sealing strip or gasket 17 of rubber interposed therebetween. Each of the hollow sections 14 is configured to provide a pair of opposed recesses 18 situated substantially centrally of the depth of one of the stiles 12, 13.

The stile 12 has therein a hook bolt lock 19 including a pair of spaced attachment plates 20, 21 seated in the recesses 18 and interconnected by a pair of screws 22, 22 passing through the plate 21 and threaded into a pair of projections 23, 23 extending from the plate 20. A lock casing 24 is mounted on the attachment plate 20 and accommodated in the hollow section 14 of the stile 12. The lock casing 24 contains therein a mechanism (not shown) that can be actuated by a key 25 inserted in a keyhole in a lock cylinder 26 to enable a hook bolt 27 to pivot through a bolt aperture 28 into and out of engagement with a strike plate 29 fixed to the stile 13. The hook bolt 27 thus projects in a direction normal to the planes in which the doors 10, 11 are movable.

The strike plate 29 is seated in one of the recesses 18 of the stile 13 and is connected to an attachment plate 30 in the other recess 18 by a pair of screws 31, 31 passing through the strike plate 29 and threaded into a pair of projections 32, 32 extending from the attachment plate 30. A block 33 is mounted on the attachment plate 30 and is accommodated in the hollow section 14 of the stile 13. A pusher rod 34 is slidably supported in the block 33 and is normally biased away from the strike plate 29 by a spring (not shown) contained in a sleeve 35. The pusher rod 34 has on one end a knurled grip plate 36 and on the other a noncircular head 37, herein shown to be a square-shaped head, which is engageable with the mechanism in the lock casing 24.

The pusher rod 34 serves also to project and retract the hook bolt 27. When the pusher rod 34 is pushed against the bias of the spring in the sleeve 35, the square-shaped head 37 is moved to pass through a central opening 38 in the strike plate 29 and through a hole 39 in the attachment plate 21 of the stile 12 until the head 37 engages the mechanism in the casing 24. Upon rotation of the grip plate 36 in a predetermined direction, such as a clockwise direction, about the longitudinal axis of the pusher rod 34, the head 37 actuates the mechanism to move the hook bolt 27 through the bolt aperture 28 into engagement with the strike plate 29. When it is desired to unlock the bolt 27, then the pusher rod 34 is rotated counterclockwise to release the mechanism.

Figure 3A:
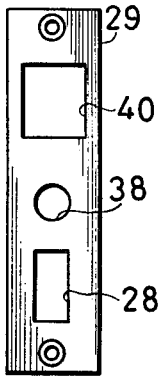
FIG. 3A is a front elevational view of the strike plate.
Figure 3B:
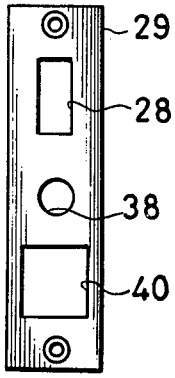
FIG. 3B is a view similar to FIG. 3A but showing the plate inverted for adjustment.

The bolt aperture 28 in the strike plate 29 has a width sufficiently wide to permit the hook bolt 27 to be received therein without substantial clearance or play. The strike plate 29 has an additional bolt aperture 40 of a wider width than the bolt aperture 28 (FIGS. 3A and 3B). The bolt apertures 28 and 40 are located one on each side of and symmetrically in position with respect to the central opening 38, so that when the strike plate 29 is inverted, that is, from the position shown in FIG. 3A to the position shown in FIG. 3B, the hook bolt 27 when actuated can also be received in the additional bolt aperture 40 unobstructedly. Therefore, when the doors 10, 11 are fully closed and if the hook bolt 27 fails to extend into the bolt aperture 28 because typically of variations in dimension of the doors and frame, then the strike plate 29 is turned upside down to let the bolt aperture 40 of a wider width receive therein the hook bolt 27 which would otherwise abut against the outer surface of the strike plate 29. Furthermore, since the strike plate 29 requires no screw slot for adjustment, the plate can be free from displacement and the screws 22 and 31 do not get loosened.

Although various minor modifications may be suggested by those versed in the art, it should be understood that I wish to embody within the scope of the patent warranted hereon, all such embodiments as reasonably and properly come within the scope of my contribution to the art.

What I claim as my invention:

1. A hook bolt lock set for use on a pair of closure members slidable in adjacent planes and having a pair of overlapping stiles, comprising:

a. a lock for being mounted in one of the overlapping stiles, said lock having a hook bolt for spanning the space between said planes and capable of projection toward and retraction from the other overlapping stile in a direction normal to the planes in which the closure members are movable;

b. an invertible strike plate for being attached to said other overlapping stile in a position parallel to said planes, said strike plate having a central opening and a pair of apertures alternatively receptive of said hook bolt, and located one on each side of and symmetrically in position with respect to said central opening, one of said apertures being wider in width than the other; and c. means connected to said plate and slidable through said central opening for actuating said lock from the side of said other overlapping stile.

2. A hook bolt lock set according to claim 1, said actuating means including a slidably supported pusher rod having an inner end of non-circular cross-section drivingly receptive in said lock, said pusher rod being normally biased away from said strike plate, and said inner end being movable through said central opening into driving engagement with said lock when the closure members are fully closed.

3. A hook bolt lock set according to claim 1, including an overlapping stile having a recess in which said strike plate is fixedly but invertibly disposed and secured in a single position, and a second overlapping stile having at least one recess in which said lock is fixedly disposed and secured in a single position.

* * * * *